United States Patent [19]

Babunovic et al.

[11] 3,952,925

[45] Apr. 27, 1976

[54] FLOW CONTROL SYSTEM AND ROTARY FLOW CONTROL VALVE

[75] Inventors: Momir Babunovic, Des Peres; Mihai A. Bulboaca, St. Louis County, both of Mo.

[73] Assignee: Barry-Wehmiller Company, St. Louis, Mo.

[22] Filed: Feb. 5, 1975

[21] Appl. No.: 547,236

[52] U.S. Cl. ..... 222/485; 138/30; 137/207

[51] Int. Cl.[2] ..... B67D 3/00

[58] Field of Search ..... 417/540; 137/207, 624.13; 134/129, 152, 166 R, 169 R; 138/30; 222/482, 483, 484, 485, 486, 548, 554, 555

[56] References Cited

UNITED STATES PATENTS

| | | | |
|---|---|---|---|
| 2,827,928 | 3/1958 | Guchel | 222/486 X |
| 3,111,131 | 11/1963 | Nekola et al. | 134/129 |
| 3,473,480 | 10/1969 | Kullmai | 417/540 |
| 3,473,565 | 10/1969 | Blendermann | 138/30 X |

*Primary Examiner*—Robert B. Reeves
*Assistant Examiner*—Larry H. Martin
*Attorney, Agent, or Firm*—Gravely, Lieder & Woodruff

[57] ABSTRACT

A flow distribution system which embodies a source of fluid under pressure, a plurality of delivery lines, a rotating valve body which progressively connects the source of fluid with the delivery lines, a housing for the rotating valve and means in the housing to absorb the shocks of redirecting the fluid flow to each of the delivery lines and releasing the absorbed energy back to the fluid flow to subsequent fluid lines as a resonant system.

10 Claims, 9 Drawing Figures

FLOW CONTROL SYSTEM AND ROTARY FLOW CONTROL VALVE

BRIEF SUMMARY OF THE INVENTION

This invention pertains to a flow control system and rotary fluid flow control means disposed in a principal fluid supply line which furnishes fluid under pressure to a system of nozzles for rinsing containers, such as bottles, and to the control means employed in a resonant system.

The art of rinsing bottles is an exacting one for the reason that the bottles usually are used to contain edible material, and proper rinsing requires a forceful jet of fluid projected into the bottles periodically. Bottle rinsers usually are constructed to handle large numbers of bottles while in motion. The fluid jets need to be moved so as to maintain alignment with successive groups of bottles, and in this successive alignment requirement the jets deliver intermittent slugs of solution by the periodic and rapid closing and opening of the fluid dstributing passages. The periodic opening and closing of such passages can cause harmful "strain" on the valve components, and the strain or "water hammer" arises when a valve is suddenly shut down without first cutting off or substantially reducing the flow.

The present invention has as a principal object the provision of delivering fluid jet slugs to the interior of containers in a rapid series of jets, and incorporates means in that system to establish the intermittent nature of the jet slugs along with means to absorb the energy developed by changes in pressure when the fluid flow toward the jets is cut off and then return the absorbed energy to the restoration of flow so that such energy can be applied to reinstitute flow toward the jets much more rapidly.

Other objects of the present invention are to provide in a resonant system an improved rotary flow control valve that embodies means to absorb the energy generated shocks associated with disturbing the flow of a fluid under pressure; to provide a flow control valve that is substantially free of becoming clogged if the fluid being handled contains foreign matter; to provide improved fluid flow distributing means in a valve rotor so the flow transition to several delivery lines can be smoothed out for more efficient flow; and to provide pressure shock absorbing means establishing a resonant system located adjacent to discharge ports to minimize the hydraulic losses and which can be adjusted to meet the needs of the pressure available at the source of fluid and the rotational speed of the valve.

A preferred embodiment of the present invention comprises a system represented by a unique flow control valve having a chamber enclosing a partition therein formed with flow delivery openings communicating with separate discharge lines, a fluid supply line communicating with the chamber, a rotary valve in the housing positioned at the partition to successively establish communication between the fluid supply line and the discharge lines through the partition delivery openings, and energy absorbing and releasing means in the chamber to absorb the shock of the transition of fluid under pressure from flow to no flow and return the energy to the next flow to another of the partition openings as the valve body rotates adjacent the partition to open subsequent openings.

BRIEF DESCRIPTION OF THE DRAWINGS

The presently preferred form of the flow control valve is seen in the accompanying drawings, wherein.

DETAILED DESCRIPTION OF THE EMBODIMENT

Figure 1:
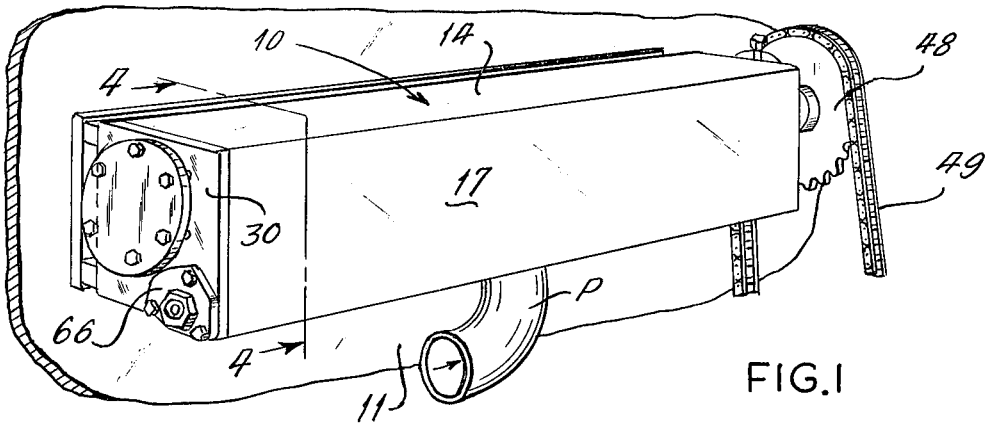
FIG. 1 is a perspective view of the rotary flow control valve mounted on the wall of a container rinsing apparatus.
Figure 2:
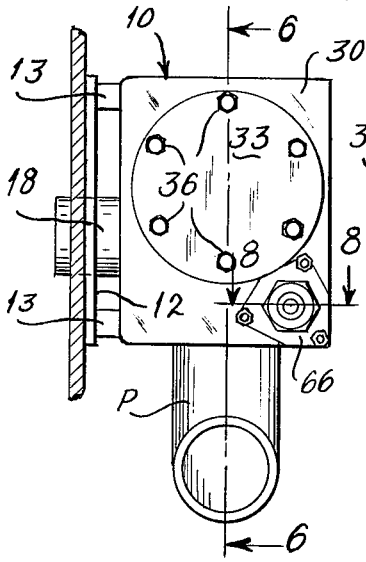
FIG. 2 is a view of the valve housing as seen from the end in FIG. 1.
Figure 3:
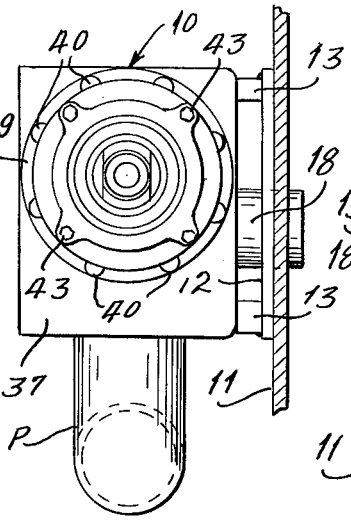
FIG. 3 is a view similar to FIG. 2, but of the other end of the valve housing.
Figure 4:
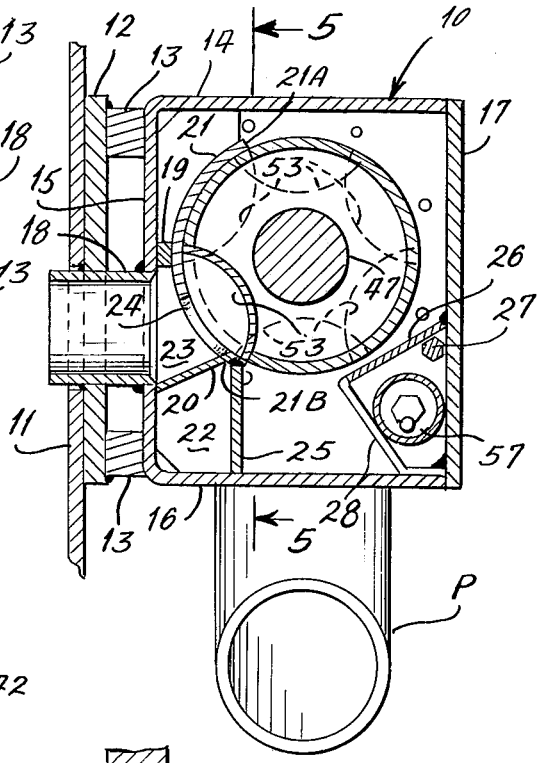
FIG. 4 is a transverse sectional view of the rotary flow control valve assembly as seen along line 4—4 in FIG. 1.

The general arrangement of the rotary flow control valve may be seen in FIG. 1, 2 and 3 where the housing 10 is positioned on the wall 11 of the rinser tank by means of an adapter plate 12 and spacer strips 13. The housing 10, as seen in FIG. 4 is formed of a first sheet bent into a U-shape so as to form a top wall 14, a side wall 15 and a bottom wall 16, thereby leaving an open side to be closed by a separate wall sheet 17.

The control valve represented at 10 is included in a flow system in which fluid is delivered by a suitable pump or other source of pressure (not necessary to show) to the inlet pipe P and is distributed in a predetermined sequence to a series of outlets for delivery to a plurality of jet nozzles which inject the fluid to containers. As will be referred to presently, the system broadly described here is of the character shown in Nekola et al. U.S. Pat. No. 3,111,131 granted Nov. 19, 1963 to the assignee of this application.

Figure 5:
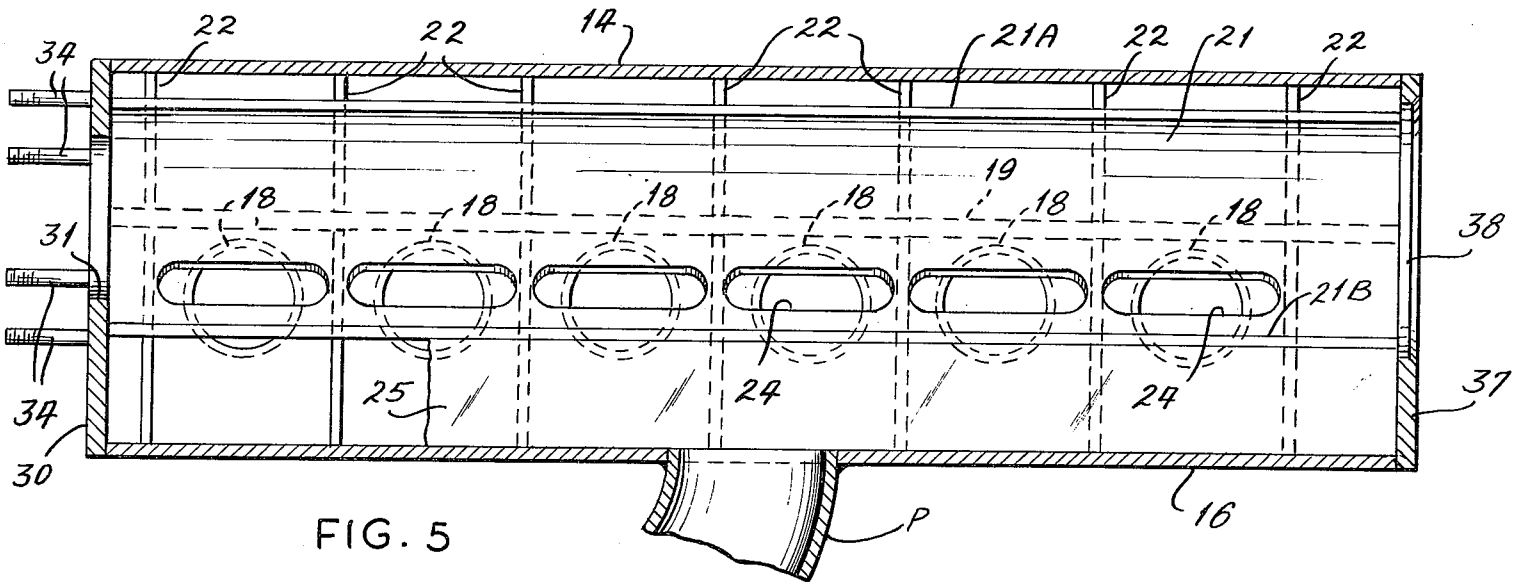
FIG. 5 is a longitudinal sectional view of the chamber showing the partition and the several fluid delivery openings and discharge lines, the view being taken along line 5—5 in FIG. 4.

The housing side wall 15 (FIGS. 4 and 7) is formed with a plurality of apertures to receive fluid flow directing nipples 18 which are welded to the apertures in the wall and extend through the mounting adapter plate 12 and into the tank through the wall 11. Inside of the housing and spaced from the vertical wall 15 by a seal strip 19 and a wall 20 is a stator in the form of a partition 21 (FIGS. 4 and 5) formed as a segment of a circle having an upper margin 21A and a lower margin 21B. This partition extends lengthwise of the housing and is supported by vertical ribs 22 which extend from the top wall 14 to the bottom wall 16, and have margins which conform to the arcuate shape of the partition 21 so as to retain this partition in desired alignment. The seal strip 19 and the wall 20 cooperate with the back of the arcuate partition 21 and with the housing wall 15 and dividing ribs 22 to form separate pockets 23 (FIG. 4) which open to the respective nipples 18, and which open through slots 24 in the partition 21 to the face side thereof. The partition 21 (FIGS. 4 and 5) is further supported in the housing by a wall 25 which rests on the bottom wall 16.

The components that support the arcuate partition 21 are assembled in the housing 10 before the wall 17 is installed to complete the unit. Before the assembly is completed, the wall 17 is supplied with a partition 26 that is secured on the inside of the wall with the aid of a hexagonal rod 27 which provides surfaces for welding and acts as a wall stiffener, too. The outer margin of the partition 26 is held in position by a strap 28 which is secured at the lower end to the wall 17. When wall 17 is put into position it establishes a pocket area below the partition 26 for the reception of a shock absorbing means to be described presently and locates this means closely adjacent the area of the ports 23.

Figure 9:
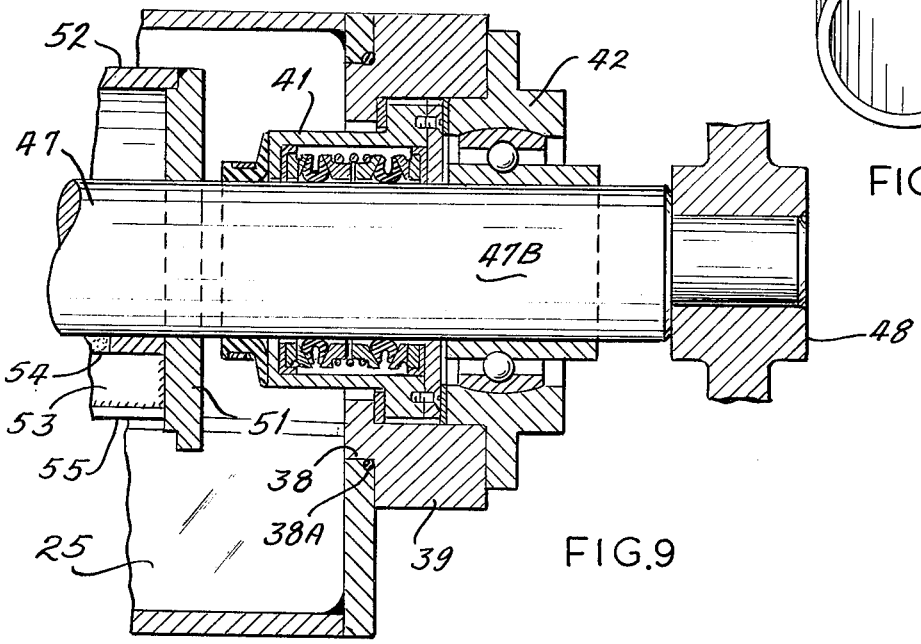
FIG. 9 is a fragmentary view of the bearing mounting for the drive end of the valve mandrel or shaft, the view being taken along line 9—9 in FIG. 7.

The structure described above relates to the components that make up the housing and its interior structure, and especially the structure that supports the arcuate partition 21 in a fixed position, and keeps its face surface in true longitudinal alignment. The opposite ends of the housing 10 are closed by end walls, one of which is seen at 30 in FIGS. 1, 2, 5, 6 and 7. In these views the end wall 30 is seen to be formed with an aperture 31 to receive a bearing 32. This bearing 32 is secured in place by a retainer plate 33 held in position by a group of studs 34 which extend through the plate 33 and a suitable gasket 35, and receive nuts 36. The bearing 32 has an "O" ring seal 35A at the aperture 31. The opposite end of the housing 10 is closed by a wall 37 (FIGS. 3, 5, 6 and 7) having an enlarged aperture 38. The aperture 38 has its center aligned with the center of the aperture 31 and with the center line of the cylindrical inner surface of the partition 21. A bearing adapter 39 is secured in the aperture 38 by screws 40 (FIG. 3), and an "O" ring seal 38A is used to seal this joint. The adapter supports a mechanical seal 41 (FIG. 9), held in place by the bearing unit 42, also held by nuts 43 engaged on the ends of suitable studs (FIG. 3). The bearing adapter 39 is provided with a flushing supply fitting 44 (FIG. 6) and a drain fitting 45. The supply of flushing fluid (not shown) is needed to keep the mechanical seal 41 free of abrasive material in the fluid that is circulated through the housing 10 from the supply pipe P, since the fluid in the housing is a caustic solution with abrasive particules in suspension (such as glass, paper fiber etc.).

The bearing 42 and the first mentioned bearing 32 are aligned for the purpose of supporting a shaft 47 which extends through the housing from the journal 47A at bearing 32 to the opposite end journal 47B mounted in the inner race element 42A of the bearing 42. The shaft 47 extends outwardly through the bearing 42 to receive the drive sprocket 48 (FIGS. 1, 6 and 7) which is actuated by chain 49 from a reducing drive (not shown).

The shaft 47 supports a plurality of spaced discs 51, there being 7 such discs in this case, and each pair of discs supports a mantle 52 which, in the example shown, is a sleeeve extending around substantially 292° of the discs 51 so that there is left an opening of 68°. The respective mantles 52 are oriented down the length of the shaft so that the openings are spaced around the shaft at 60° intervals. As seen in FIG. 4, the openings are closed by cup shaped plates 53 set inside the openings and secured to the shaft by weld plugs 54 and to the mantle 52 and disc 51 by weld seams 55 (FIG. 6).

In this manner the shaft is provided with six cups 53 staggered around at 60° intervals. The shaft 47 and its complements of mantles 52 is removable from the housing through the aperture 38 in the end plate 37 (FIG. 6).

Figure 6:
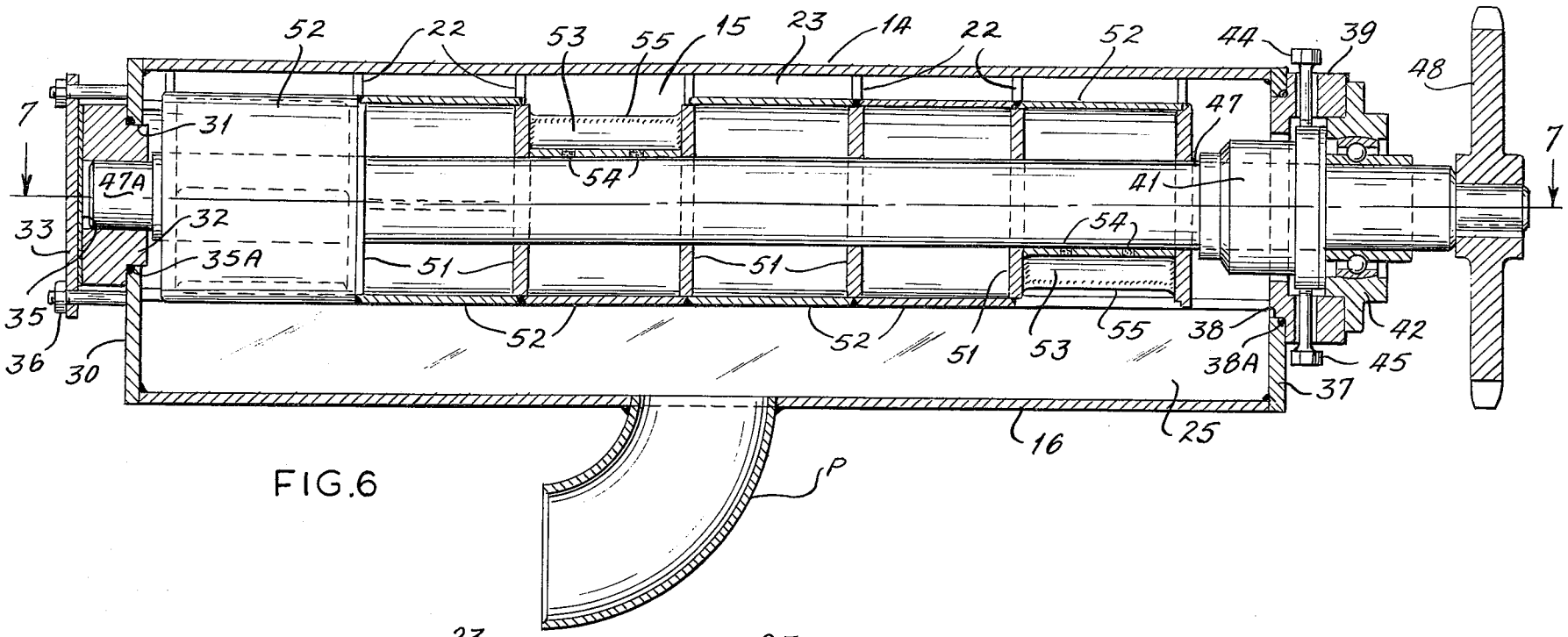
FIG. 6 is a longitudinal sectional view of the rotary valve body in the chamber to which fluid under pressure is supplied, the view being taken along line 6—6 in FIG. 2.

It is seen in FIGS. 4 and 6 that the cylinder formed by the mantles 52 is substantially the same as the section of the cylinder for the partition 21. An operating clearance at the partition 21 face surface is provided so that foreign matter that may be entrained in the caustic solution supplied to the housing 14 will not interfere with the free rotation of the mantles 52 across the partition face. This arrangement achieves self cleaning since the stationary partition 21 does not wrap about the rotating valve, thereby allowing the rotor to sweep foreign matter out of the facing surfaces. As is seen in FIG. 4 the caustic solution in the housing 14 is directed by each cup 53 through the associated ports 24 as the cups pass across the ports. The periodic movement of each cup 53 across its associated port 24 will create a "water hammer" reaction in the housing and with six such cups 53 there will be a continuous series of hammer pulses as a slug of fluid is released through each port 24 and then chopped off by the trailing edge of the cup 53 and mantle 52. A typical example of the environment in which the present rotary valve is used is seen in the before noted Nekola et al. U.S. Pat. No. 3,111,131 issued Nov. 19, 1963. In that patent a valve 19 of poppet type is used to control the periodic supply of fluid to nipples 32 which are connected by flexible hoses 20 and 21 to headers 76 having the discharge nozzles 77. The present rotary valve is intended to replace the valve 19 of that prior patent so as to improve the quality of fluid delivery and obtain a greater capacity of slugs of fluid. For example, it has been found that the shaft 47 with its plurality of cups 53 can operate in a speed range of from 250 to 350 RPM, and that the pressure of the fluid supplied at pipe P may be varied over a range of from about 10 pounds to as much as 50 pounds. At 300 RPM, with six cups 53, there will be 1800 pressure pulses developed in the housing which is considerably higher than formerly.

Figure 8:
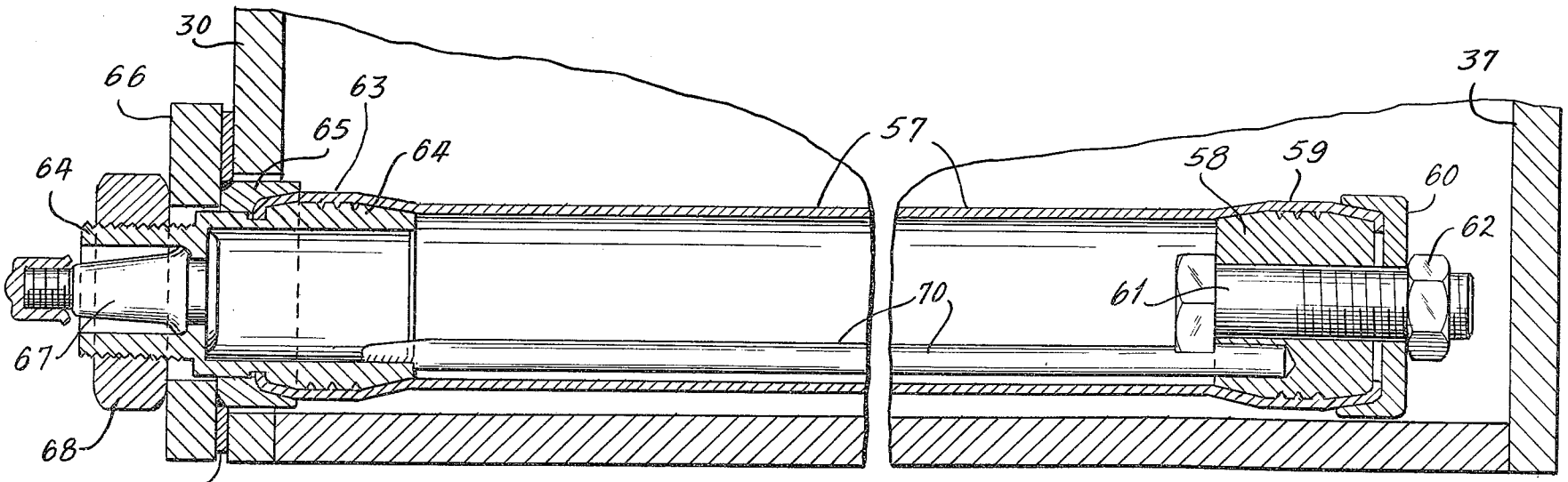
FIG. 8 is a fragmentary and enlarged view of the pressure shock absorbing means disposed in the chamber, the view being seen along line 8—8 in FIG. 2.
Figure 7:
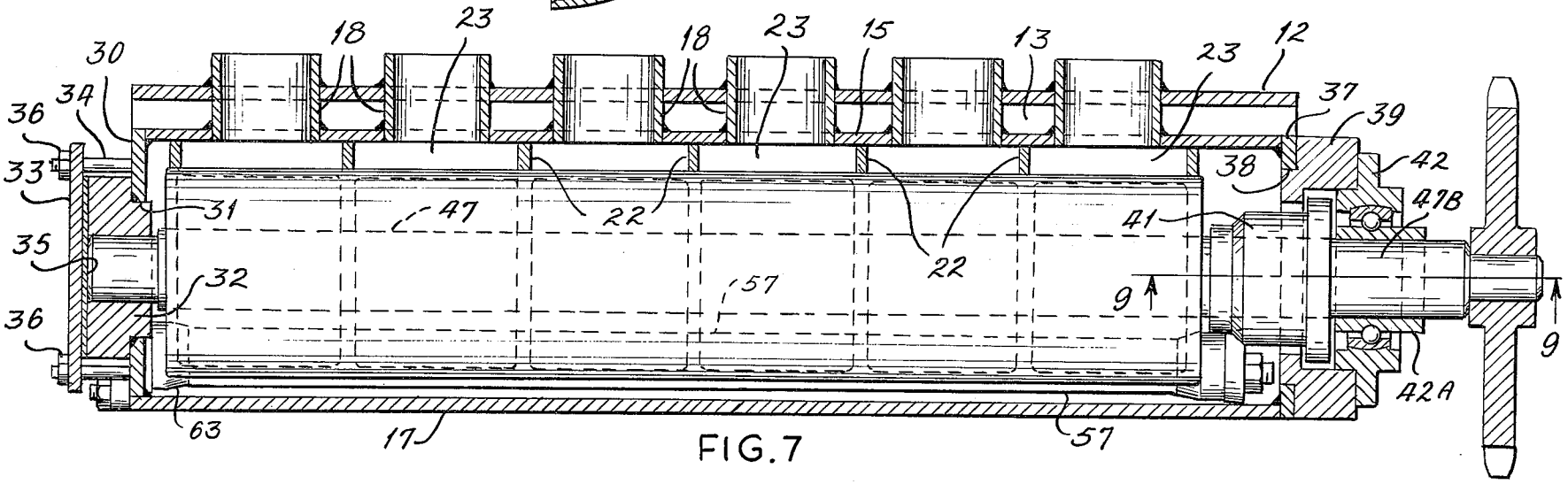
FIG. 7 is a longitudinal sectional view taken along line 7—7 in FIG. 6.

However, in operating at the substantially higher speed the "water hammer" effect is considerable and must be abated, and in the present assembly shock absorber means is employed inside the housing 14. This means is seen in FIGS. 7 and 8, and its location is seen in FIGS. 1, 2 and 4. The shock absorber means is a flexible walled tube 57 formed from Neoprene hose or similar material. This tube 57 is located very close to the series of ports 24 so that there will be very little loss in the transmission of the water hammer pulse from the area of the ports. The tube itself is mounted on a mandrel 58 which supports the outer end 59 of the tube in cooperation with a compression cap 60 that is drawn in by the bolt 61 and nut 62 mounted in the mandrel 58. The opposite end 63 of the tube 57 is secured over a hollow mandrel 64 by a compression ring 65. The ring 65 is in abutment with a removable cover 66 (FIGS. 1, 2 and 8) bolted on the end plate 30 of the housing 14. In FIG. 8 the mandrel 64 is formed with an extension portion 64A which forms a well to receive a valve 67. The extension 64A also receives a jam nut 68 that draws the mandrel 64 against the ring 65 held by the cover 66. A gasket 69 is placed under the cover 66 to provide a liquid seal.

The respective mandrels 58 and 64 are maintained in spaced relation by a rod 70 of suitable length to position the tube 57 along the length of the housing and under the partition 26 (FIG. 4). The valve 67, of common automotive tire type, is provided to control the initial pressure inside the tube 57 so that various conditions of compression reaction of the tube wall to "water hammer" in the housing 14 may be created. In a preferred installation the tube 57 had an inside diameter of about 2½ inches, and was operated at pressures that ranged from about 20 pounds to 80 pounds. In view of the intent to have the tube wall yield to pressure pulses in the housing 14, it has been found that good shock absorbing reaction is obtained with the tube internal pressure of from 20 to 40 pounds. This pressure is obtained by supplying air through the valve 67 and using a tire pressure gauge or similar gauge to show the condition. The flexing of the tube wall is confined under the wall 26 and by the strap 28 so that there will be no possibility of the tube being engaged by the rotating mantles 52. The strap 28 is sufficiently wide to act as a protective barrier at the supply pipe P so that the incoming fluid will not direct its abrasive particles directly on and erode the tube 57.

In the present arrangement the pressure condition in tube 57 is regulated so that the pressure in the housing 14 will partially collapse the tube until the pressures inside the tube and in the housing are equal. Thus, the internal tube pressure is intially less than the housing pressure so that the housing pressure can collapse the tube wall to raise the internal tube pressure until the tube wall is in equilibrium. Now when the closing of each port 24 takes place, the water hammer effect will be immediately transmitted to the tube 57 to further collapse the tube wall and increase the internal pressure. This further collapsing action on the tube wall will absorb the water hammer shock very effectively, and the absorbing of the shock will transfer the energy of the shock into the body of air in tube 57. As one port 24 is closed, as described above, the next port 24 will open and now the energy absorbed by the tube, which raised the tube pressure above the housing pressure, will be released to aid in starting the flow of fluid into the now opening next port 24. This action by the tube 57 will, therefore, absorb the energy on each port closing and return it to boost the flow each time another port opens.

The foregoing description of the events which occur in the present system has set forth the manner in which it has become useful to convert and store the kinetic energy created by periodic abrupt interruption of flow of an incompressible media, and subsequently return or release the stored energy into the intermittent flow of the same media so as to result in an increase of the energy in the intermittent flow and give such flow a useful boost. In the embodiment disclosed the rotating valve converts steady flow through the supply pipe P of the incompressible fluid into a plurality of pulsating flows at the respective nipples 18 which constitute the fluid discharge lines. This conversion is accomplished with better efficiency than is possible with prior means by virtue of the ability of the valve to convert kinetic energy of the incoming steady flow into potential energy at the collapsible tube 57 and to then release this potential energy from tube 57 at the proper time to augment the energy in the flow at the several discharge lines.

The foregoing description has set forth a presently preferred structure for the rotary flow control valve in which there is featured a cylindrically shaped partition 21 that is presented to the rotating assembly of mantles 52 and cups 53 for freedom from clogging, a staggered series of flow directing cups 53 which direct the caustic fluid under pressure from the housing 14 through the ports 24, one at a time, for flow through the nipples 18 in slugs of fluid and means in the form of a flexible hose 57 to absorb the energy in the "water hammer" shock caused by the several cups 53 chopping off the discharge flow. A unique feature of the assembly is the presence of a pressure in the hose 57 which, working as an elastic system at resonance, while yielding to the "water hammer" effect, will supply a useful force to the fluid discharge by the rebound effect of the hose wall resuming its shape following contraction. Thus, the resumption of flow through each port 24 will be accelerated very rapidly by the restoring pressure behind the wall of the tube 57. The resonance frequency may be varied by changing the initial pressure in tube 57 through the valve 67 to meet the needs of each operating condition.

The system is tuned in this manner to obtain an elastic response from the tube 57 which is in resonance with the pulsations in the rhythmic opening and closing of the rotor carried on shaft 47.

What is claimed is:

1. In a fluid flow control system having a pressure fluid supply and a plurality of discharge lines for receiving and discharging the same supply fluid, the improvement of a housing providing a chamber to receive the pressure fluid, means in said housing forming a plurality of separated fluid discharge ports in communication with the discharge lines, flow regulating means operably mounted in said housing adjacent said ports to successively open and close said ports such that the closing of one port is followed by the opening of another port, and an elongated fluid discharge flow-boosting flexible-walled expandable-collapsible means in said housing positioned adjacent all of said ports in position to absorb and store the energy of fluid flow interruption by each port closing and return the absorbed stored energy to freely boost the flow at the next port opening, whereby said flow boosting expandable-collapsible means substantially overcomes friction losses by being adjacent all of said ports.

2. The improvement set forth in claim 1 wherein, said expandable-collapsible means is a tube having a flexible wall and an initial internal pressure less than the pressure of the fluid supply such that said tube wall is partially initially collapsed until the external fluid pressure and internal pressure across the wall is in equilibrium.

3. The improvement set forth in claim 1 wherein, the pressure fluid is an incompressible fluid, and said expandable-collapsible means is a flexible-walled member having a compressible fluid therein under initial pressure less than the pressure of the incompressible fluid, whereby said member flexes and delivers the stored energy to boost flow at said ports in resonance with the rhythm of opening and closing of said discharge ports.

4. The improvement set forth in claim 1 wherein said flow regulating means operates the opening and closing of said ports at a substantially steady rate and sets up pressure shock waves having a substantially steady frequency, and said fluid discharge redirecting means responds in kind, whereby the kinetic energy in the shock waves is absorbed in and returned by said fluid discharge redirecting means to the fluid to increase the energy in the flow through an open port.

5. In a fluid flow control system for bottle washers using a washing solution, the improvement of a housing having a washing solution inlet and at least a pair of outlets in spaced relation to said inlet, a partition in said housing between said inlet and outlets and having the shape of a segment of a cylinder, said partition being formed with a port opening from said housing to each of said outlets, a valve member mounted in said housing and movable over said partition to periodically open and close said ports, said valve member including a cylindrical mantle having openings and flow directing cups fixed in said mantle openings, said mantle having a curvature complementary to said partition shape, and said cups being positioned to open said ports for the discharge of solution from said housing, said valve member further being moved at a rate to cause water hammer effects upon closing of each of said ports, and means in said housing responsive to the water hammer effect to absorb the shock thereof and use the shock energy to improve the flow to the next port.

6. The valve assembly set forth in claim 5 wherein said valve member is a rotor moving about a fixed axis of rotation, and said partition is formed with a face surface equidistant at all points from said axis of rotation such that said valve member and partition face are complementary to each other.

7. The valve assembly set forth in claim 5 wherein said means responsive to water hammer effect is a flexible walled member disposed within said housing to be exposed to pressure changes in the washing solution in said housing.

8. The valve assembly set forth in claim 7 wherein said flexible wall container is internally pressurized so as to resist collapse.

9. In a fluid flow control system the improvement of a housing having an inlet for an incompressible fluid, means in said housing forming a plurality of separate pockets in side-by side alignment, said means including a partition having a face surface in the shape of a segment of a cylinder and ports in said face surface opening one to each of said pockets, fluid discharge means opening from each pocket, an elongated cylindrical valve rotatably mounted adjacent said cylindrical face surface, said valve having a series of recesses aligned one with each port, means rotating said valve to move said recesses across said ports one at a time, for admitting and stopping fluid flow through said ports and outwardly through said discharge means, and means in said housing adjacent said ports to absorb the energy in the shock of pressure pulses generated in said housing as said valve recesses stop the fluid flow through each of said ports, said last means releasing the absorbed energy into the fluid flowing to an open port.

10. The rotary valve assembly of claim 9 wherein said shock absorbing means is a hollow flexible wall member disposed in said housing and having a portion thereof located outside said housing, and valve means disposed in said portion of said hammer to permit pressurizing said member.

* * * * *